United States Patent [19]

Petersen

[11] Patent Number: 4,543,551

[45] Date of Patent: Sep. 24, 1985

[54] APPARATUS FOR ORIENTING MAGNETIC PARTICLES IN RECORDING MEDIA

[75] Inventor: Christian C. Petersen, Cambridge, Mass.

[73] Assignee: Polaroid Corporation, Cambridge, Mass.

[21] Appl. No.: 627,055

[22] Filed: Jul. 2, 1984

[51] Int. Cl.[4] ..... H01F 7/02; H01F 7/20

[52] U.S. Cl. ..... 335/284; 335/302; 335/306; 118/640

[58] Field of Search ..... 335/284, 302, 304, 306; 360/134, 131; 118/640, 623; 427/48

[56] References Cited

U.S. PATENT DOCUMENTS

| | | | |
|---|---|---|---|
| 2,711,901 | 6/1955 | von Behren | 274/11.4 |
| 2,796,359 | 6/1957 | Speed | 117/62 |
| 3,117,065 | 1/1964 | Wootten | 204/20 |
| 4,003,336 | 1/1977 | Koester et al. | 118/640 |
| 4,197,563 | 4/1980 | Michaud | 360/56 |
| 4,208,447 | 6/1980 | Bate et al. | 427/48 |
| 4,332,834 | 6/1982 | Takri | 427/48 |
| 4,338,643 | 7/1982 | Tadokoro | 360/135 |
| 4,382,244 | 5/1983 | Koester et al. | 335/284 |
| 4,385,587 | 5/1983 | James et al. | 118/50 |
| 4,394,404 | 7/1983 | Suzuki et al. | 427/48 |

FOREIGN PATENT DOCUMENTS 55-163633 8/1979 Japan .

*Primary Examiner*—Harold Broome
*Attorney, Agent, or Firm*—Leslie J. Payne

[57] ABSTRACT

There is disclosed a magnetic assembly for use in orienting the magnetic particles which are orientable under the influence of a magnetic field. A non-magnetic housing assembly defines a storage area containing a plurality of discrete permanent magnets. Provided is an assembly for attracting the magnets to the interior of the assembly and a cover assembly which serves to restrain and protect the magnets. Such a cover assembly is made of a material which does not inhibit the natural extension of the lines of flux of the fields of the magnets.

6 Claims, 3 Drawing Figures

APPARATUS FOR ORIENTING MAGNETIC PARTICLES IN RECORDING MEDIA

BACKGROUND OF THE INVENTION

In general, this invention relates to an apparatus for use in producing magnetic recording media. In particular, it relates to an improved apparatus for orienting the magnetic particles used in the manufacturing of such media.

Several techniques are known for producing magnetic recording media. Typically, they include applying a magnetic coating containing tiny magnetic particles uniformly dispersed in a curable binder on a tape or disk surface. For giving the particles a preferred directional orientation they are passed through a magnetic orienting field. This is done so that their axes of easy magnetization align with the flux of the field. Use of magnetic recording media is determined typically by the orientation of the magnetic particles. For permanently setting these particles in a desired orientation, the coating is cured or dried.

The most common orientation for such particles is to have their axes of easy magnetization arranged in end-to-end fashion along the longitudinal extent of, for example, a tape. This is usually achieved by a pair of spaced-apart permanent bar-type magnets having poles of the same polarity facing each other and passing the magnetic layer between the oppositely facing poles.

Examples of known techniques for achieving the foregoing kind of orientation are illustrated and described in the following U.S. Pat. Nos.: 2,711,901; 3,117,065; 3,437,514 and 3,775,178.

For purposes of enhancing the density packing of particles, so as to improve recording characteristics of recording media, it has been proposed to orient these particles so that their axes of easy magnetization are generally perpendicular with respect to the tape surface. By having them generally perpendicular, there is greater concentration of particles per unit area having the desired orientation. Accordingly, more electronic information can be stored.

Previously referenced U.S. Pat. No. 2,711,401 also illustrates and describes a process, whereby the magnetic particles are oriented generally perpendicularly. This is achieved under the influence of a magnetic field created by permanent magnets spaced apart and having magnetically opposing poles facing each other. As the particles pass through this field in an uncured binder, they tend to rotate so that their easy axes align with the flux lines of such fields. Subsequently, the binder is cured for permanently setting the particles in this preferred orientation. However, upon leaving the field, the still uncured particles tend to assume a generally horizontal orientation.

The foregoing described patents use unprotected bar-type permanent magnets for orienting the particles. For generating sufficiently strong fields for orienting purposes, these magnets tend to be relatively large. Recently, it has been proposed to use stronger rare earth magnets for effecting such orientation. U.S. Pat. No. 4,338,643 describes an approach using high coercivity magnets, such as samarium cobalt for orienting the magnetic particles. In general, however, use of high coercivity magnets, presents problems because they tend to be relatively expensive and relatively small in size. Also, these magnets are relatively difficult to handle due to their strong fields. Hence, their assembly in closely packed and stable relationship, whereby all magnets are in juxtaposed relationship with the poles facing in a common direction is often difficult due to the repulsive and attractive forces. Known orienting magnets in this field tend to be physically unprotected. This is a significant drawback when manufacturing magnetic recording media, since there is a possibility that their effectiveness is diminished by uncured coating material contacting them.

SUMMARY OF THE INVENTION

It is an object of the present invention to provide an improved apparatus for use in orienting particles orientable under the influence of a magnetic field. In accordance with this invention there is a non-magnetic housing assembly defining a storage area. Stored in the area is a plurality of discrete permanent magnets which define high strength fields. The magnets are stored in the area in juxtaposed and predetermined relationship to one another. Each of the magnets has one of its poles facing away from the assembly and in the same general direction as the other magnets. The opposite pole of each of the magnets face toward the assembly. Disposed in the assembly is means for facilitating magnetic attraction between it and the opposite poles, whereby the assembly and retention of the magnets in and to the storage area are enhanced. Included in the housing assembly is a cover assembly which is in overlying and contacting relationship to each of the one poles of the magnets. This is for physically restraining the magnets in the predetermined relationship as well as shielding them from dirt and debris. The cover is made of a material which does not inhibit the natural extension of the field of the magnets and is configured to slidably support a advancing web tape.

Among the objects of the invention are, therefore, the provision of an improved apparatus for orienting particles orientable under the influence of a magnetic field; the provision of an apparatus of the foregoing type wherein a plurality of high coercivity permanent magnets can be maintained in juxtaposed and predetermined relationship; the provision of an apparatus which uses magnetic and physical constraints to maintain the magnets in their predetermined relationship; the provision of a cover assembly which is made of a material that does not inhibit the natural extension of the field of the magnets, protects the magnets from physical damage and supports a passing web carrying the particles in close proximity to the magnets.

Other objects and further scope of applicability of the present invention will become apparent from the detailed description to follow when taken in conjunction with the accompanying drawings wherein like parts are designated by like reference numerals.

DETAILED DESCRIPTION

Figure 1:
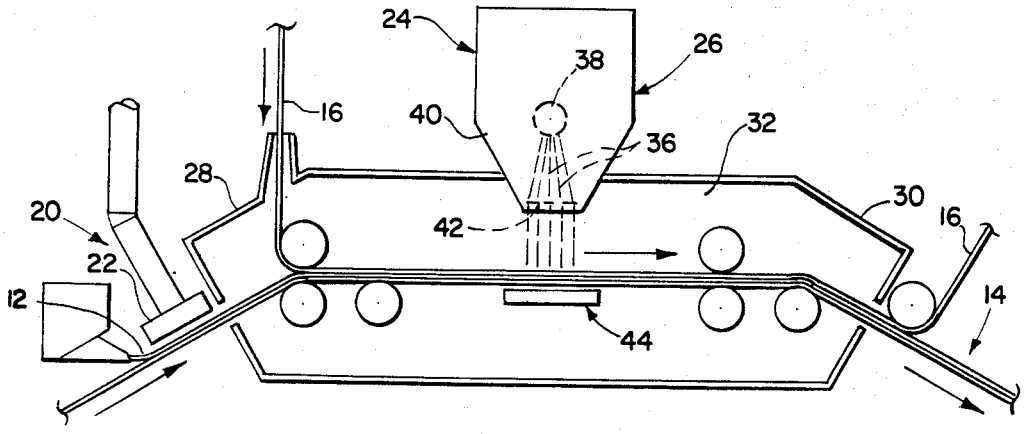
FIG. 1 is a diagrammatic view of a process for producing magnetic recording media.
Figure 2:
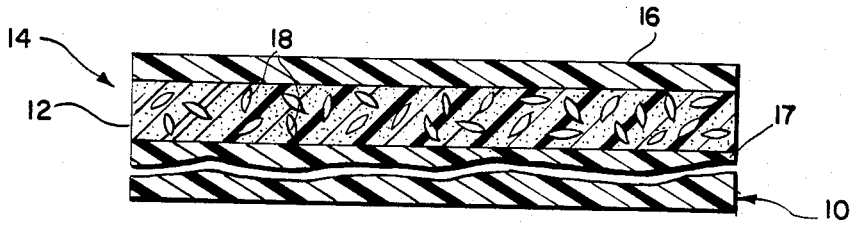
FIG. 2 is a cross-sectional view of a substrate having an uncured magnetic coating with the magnetic particles thereof in an unaligned condition.
Figure 3:
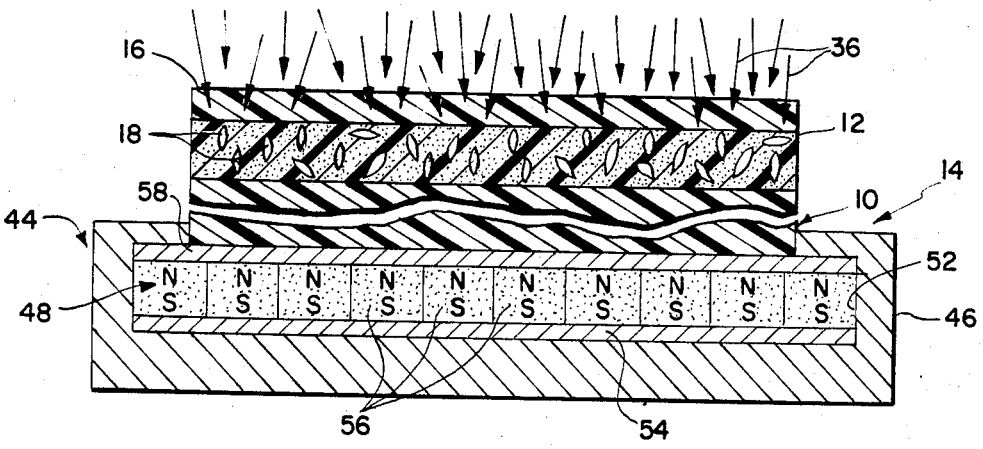
FIG. 3 is a cross-sectional view similar to FIG. 2, but with the magnetic particles oriented under the influence of a magnetic field provided by an apparatus made in accordance with the present invention.

Reference is made to FIGS. 1–3 of the drawings for illustrating an apparatus for orienting magnetic particles used in making magnetic recording media. It is contemplated that the magnetic recording media have video and audio uses.

Depicted is a carrier or supporting substrate base 10 coated with a magnetic recording layer 12. During advancement, in the direction of the arrows, the recording layer 12 will undergo a series of processing steps which are adapted for forming a magnetic recording medium 14. This embodiment describes at least one recording layer 12 forming the outer layer of the medium 14. It will be appreciated that other layers (not shown), such as subbing layers, anti-static layers and other magnetic or non-magnetic layers can be added.

Also shown, is a strippable particle retaining covering sheet 16. This covering sheet 16 is applied to the top surface of the magnetic recording layer 12 for purposes of inhibiting surface disruption caused by chaining or clumping of the magnetic particles under the strong magnetic field in the orienting step. This is advantageous since it promotes uniformity of particle distibution in the layer 12 and minimizes significantly surface disruptions thereof.

In this embodiment, the particle retaining cover sheet 16 is made of a very smooth material which is flexible, has sufficient beam strength to retain the particles in the layer 12, thereby minimizing significantly the disruptions caused by chaining of such particles when subjected to a very strong orienting field. The covering sheet 16 is applied to the layer 12 prior to orienting and after evaporation of the solvent. The particle covering sheet 16 will remain in intimate engagement with the layer 12 by reason of the wetness of the layer. Subsequent to orientation and curing the covering sheet 16 is peeled off, as will be described more fully. The particle covering sheet 16 is made of a thin sheet of polyethylene-terephithalate which will not be adversely affected by electron beam curing. On the other hand, the sheet 16 has low mass. This is to minimize unwanted absorbtion of the electron beams by the sheet. In this regard, the cover sheet 16 has a thickness which is approximately equal to that of the carrier base 10. As a result, the desired polymerization of the layer 12 will occur when it is subjected to the electron beam curing step. To facilitate peeling the sheet 16 has a suitable release agent on the side which contacts the layer 12. The sheet 16 does not react to the electron beam curing step in a manner which would adversely affect the surface or curing of the magnetic layer 12.

Other similar materials can be used for the particle covering sheet so long as they are smooth and have adequate beam strength for holding down the particles when they are subjected to the high magnetic forces of the orienting step. Moreover such materials should not deteriorate or warp when subjected to electron beams, and also not absorb too much of the beams so as to hinder polymerization of the layer 12. It will be understood the cover sheet 16 is not, per se, an aspect of the present invention. The aspects of this embodiment concerning the covering sheet 16 and its use in the manufacture of magnetic recording media are more completely described and claimed in the copending and commonly assigned application Ser. No. 627,054, which is filed July 2, 1984. Those aspects of the covering sheet 16 deemed relevant to an understanding of the present invention have been set forth herein.

The carrier base 10 can be made from a wide variety of materials typically used for magnetic recording media. These materials are dimensionally stable under environmental temperatures at which the recording media is typically used. These include, but are not limited to polyolefin groups, such as polyproplylene and the like; and polyester groups, such as polyethylene-terephithalate. In the present embodiment, the carrier base 10 is made of polyethylene-terephithalate.

Of course the carrier base 10 can have a variety of configurations for magnetic recording purposes depending on end use, for example, tape or disk. In this embodiment, the carrier base 10 can be in the form of a tape having its thickness fall within a range standard for such kinds of tape. For instance the thickness may be in the range of 0.3 to 0.75 mils. The carrier base 10 is treated by known techniques before the magnetic layer 12 is applied. Details of such preparation do not, per se, form an aspect of this invention. Hence, a description thereof has been omitted. The carrier base 10 can also form the middle layer of a double-sided tape, that is one having two magnetic layers on opposite sides.

The present invention contemplates that the magnetic layer 12 is applied to one surface 17 of the carrier base 10. A variety of coating techniques can be used for this purpose. In this connection, coating knives, doctor blades, dip coating, squeeze coating, reverse roll coating, etc. can be used.

Essentially, the composition of the magnetic layer 12 is comprised of anistropic magnetic particles 18 dispersed in a binder-solvent solution. These are generally uniformly dispersed in a solution comprising a binder which is polymerizable by electron beam energy and a solvent which can evaporate by the hot air drying techniques. Of course, the layer 12 can include conventional additives, such as a lubricant, an abrasive agent, corrosion inhibitor, antistatic agent, etc. Details of such materials have not been described, since they are not important to the present invention. The magnetic layer 12 when applied in a wet condition can have a thickness which is suitable for forming a magnetic recording tape. A thickness, for instance, in the range of $\frac{1}{2}$ to 10 microns is useful. Such a range permits the magnetic particles to rotate and assume a perpendicular orientation under the influence of the magnetic orienting field without projecting from the top surface of the layer 12.

In regard to the particles 18, they can be of the anisotropic ferromagnetic type; such as gamma-$Fe_2O_3$, cobalt-doped gamma-$Fe_2O_3$; gamma-$Fe_3O_4$; cobalt-doped gamma-$Fe_3O_4$; and other known ferromagnetic fine powders. Although ferromagnetic powders have been described, it should be appreciated that other magnetic particles can be used. Also the particles can be magnetizable.

In the illustrated embodiment, these particles 18 can have an acicular shape, such as shown in FIGS. 2 and 3. The particles 18 are added in an amount, by weight, with respect to the binder and solvent solution, that is conventional for the making of magnetic recording media. Of course, such amounts are in general determined by the eventual end use of the media. For example, floppy disks have different amounts than say recording tape.

These particles 18 can be arranged so as to have their easy axes of magnetization aligned randomly. See FIG. 2. A dispersing agent is used for facilitating this dispersion. As will be described, the particles 18 will be given a preferred orientation by a magnetic field before they are frozen or fixed with such orientation.

Now reference is made in particular to the binder. The binder should be of the type that is not only usable for making magnetic recording media, but is of the electron beam curable type. In this regard, the binder can include compounds containing an acrylayl group; an acrylamido group; an allyl group; a vinyl ether group; and, unsaturated polyesters. The foregoing examples are illustrative of some of the compounds which are electron beam curable. They are not all inclusive. In this embodiment the binder compound is made of IBMA which is a liquid monomer that can be polymerized under the application of electron beams. IBMA is an abbreviation of isobutoxymethylolacrylamide and is available from American Cyanamid, New York.

A variety of solvents can be used, for example, ketones, such as acetone; esters, such as methl acetate; ethers and glucol ethers, such as glycol dimethyl ether; tolulene etc. These solvents should have boiling points reached easily in conventional hot air drying apparatus of the type utilized in the magnetic recording media art. The solvent is evaporated prior to irradiation and orienting since its presence inhibits cohesion and promotes uneven distribution of the particles. In this embodiment, the solvent was cyclohexanane which is commercially available. At this juncture of the description it should be clear that the present invention envisions a wide variety of suitable binder/solvent solutions for use in making magnetic recording media consistent with the principles of the present invention. The invention also envisions compositions of binders having magnetic particles which can be electron beam cured without a solvent.

With continued reference to FIG. 1, it will be seen that the advancing carrier web 10 passes through a hot air drying zone 20. A hot air drying device 22 serves to intiate the evaporation of the solvent in the magnetic layer 12. In this regard conventional air drying temperatures can be used.

The travelling speed of the web 10 can be controlled by suitable means not shown and not forming part of the present invention. In this embodiment, a speed of about 50 ft./min. is adequate for purposes of carrying out the process of forming magnetic recording media. Although air drying commences before magnetic orientation, the magnetic layer 12 is still fluid enough to permit magnetic orientation of the magnetic particles 18 as will be described presently. Air drying further diminishes the solvent in the air. This promotes safety by lessening the possibility of explosion of such solvent when subject to electron beam energy of the type used. Although a preliminary drying step is performed such a step can be eliminated. Other equivalent drying techniques can be used. Whatever drying technique is used, however, should not alter the viscosity of the layer 12 to a point which hampers particle orientation under the influence of the magnetic orienting field. As noted, although a solvent is used, the present invention envisions an electron beam curable binder without a solvent.

Following the hot air drying the carrier web or base 10 advances to an electron beam curing station generally indicated at 24. Essentially, the magnetic layer 12 with electromagnetic energy in the form of electron beams. Such energy initiates polymerization of the binder which increases viscosity to the point that the particles are frozen with the orientation determined by the magnetic orienting field. Continued exposure to the irradiation effectively cures the layer 12. Also as the layer 12 is caused to cure it bonds to the base 10.

The electron beam curing step can be carried out by a conventional electron beam apparatus 26; such as the type manufactured by Energy Sciences Inc. of Woburn, Mass. Prior to the coated carrier 14 entering an electron beam plenum chamber 32, it can pass a magnet for preliminarily orienting the particles.

Upon entering the plenum chamber 32 the coating 12 is irradiated with high energy and intensity electron beams 36. These beams 36 issue forth from an electron beam energy rod 38 contained in a high vacuum chamber 40. The beams 36 are focused such that they pass through a titanium window 42 and encompass a preselcted area on the carrier web 10. The energy rod 38 is suitably operated so that it produces an acceleration voltage sufficient to effectuate the polymerization. This acceleration voltage can be in a suitable range, for example, from about 150 to 300 kilovolts. With an acceleration voltage of about 165 kilovolts the adsorbed dose in the layer 12 of the type described would be, but for the magnetic field, 8 to 10 megarads. Due to the magnetic field, the adsorbed dosage is about 4 or 5 megarads. This dosage is sufficient to cause complete curing of the layer 12 in about 0.1 seconds. It will be appreciated that the beams 36 can extend beyond the field so as to insure completion of the curing after the particles leave the orientation field. Although the curing need not be completed while the particles 18 are in the magnetic field, the dosage should be sufficient to effectuate polymerization to the point that viscosity increases so that the particles are frozen or fixed in the desired orientation.

The present invention also contemplates that other forms of electromagnetic energy can be used to bring about curing. For example ultraviolet energy might be used.

While the magnetic coating 12 is being cured under the influence of the electron beams 36, the magnetic particles 18 are being subjected simultaneously to an orienting magnetic field. The field is such that it has lines of flux generally parallel to each other during a portion of their extent in a given direction. Such a field is established by high coercivity magnets wherein the flux lines are more uniformly or tightly bundled or closely parallel to each other than flux lines developed by conventional kinds of permanent bar magnets. In this embodiment, such fields are produced by rare earth alloy magnets; such as samarium cobalt. These rare earth type magnets have relatively high coercivity with their flux lines being more closely parallel to each other than the flux lines of conventional bar-type magnets whose flux lines are in a somewhat splayed relationship to each other. By way of example, the coercivity of such magnets for purposes of the present invention can be 20,000 oersteds. A coercivity of about 10,000 oersteds would also be satisfactory. This invention, however, contemplates that conventional bar-type magnets can be used provided they have relatively high coercivity, whereby the lines of flux emanating from their surface are generally parallel for a distance which would at least travel through the magnetic recording layer 12. Although conventional magnets can be utilized for such purposes, they would of necessity have to be relatively more expensive and larger than the rare earth type magnets. The layer 12 should therefore, pass in extremely close proximity to the face of the magnets. This is because the flux lines are more closely parallel in the region immediately adjacent the face of the magnet. Use of flux lines with such a profile as noted, is extremely advantagous insofar as the axes of the anistropic magnetic particles 18 assume the orientation of the flux lines of such a field. As a result, there is a greater concentration of parallel magnetic particles 18 in a given area. Increased concentration of oriented parallel and perpendicular particles, of course, increases density packing of the particles.The aspects of this embodiment which deal with the foregoing described process and apparatus for making magnetic media are more completely described and claimed in the last noted application. The present invention is directed to an improved magnetic housing assembly.

In FIG. 3 there is depicted a magnetic assembly 44 for producing the noted magnetic orienting field. In the embodiment, the assembly 44 includes a plurality of discrete permanent magnets of the rare earth alloy type; such as samarium cobalt. They are housed in a manner to retain and protect them while at the same time not diminishing significantly the strength or the flux pattern of their fields. Such an assembly 44 produces a field wherein the flux lines are tightly bundled and extend upwardly from the top surface of the assembly 44.

For minimizing interference with the electron beams the magnetic assembly 44 is positioned below the surface of the carrier base 10 and beneath the preselected area covered by the electron beams. In this regard, the magnetic field produced by the permanent magnets extends through the layer 12 for orienting the magnetic particles 18.

It will be seen that the particles 18 tend to become perpendicularly aligned. The drawings of FIGS. 2 and 3 are illustrative only and do not reflect the relative number, concentration, or size of the particles, or for that matter the relative thicknesses of the base 10, recording layer 12 or cover sheet 16.

The field produced by the permanent magnet assembly 44 does not extend a great distance from the top of the layer 12. Thus, the lines of flux do not significantly deflect the electron beams emanating from the energy rod 38. Although there is a drop in the adsorbed dosage in the layer 12 because of the field, the magnetic field is strong enough to orient the magnetic particles 18 despite the increase in viscosity of the layer 12 brought about by the electron beam curing step. Towards this end, the magnetic assembly 44 should have coercivity or stated differently high remanence. In this embodiment a remanence of about 9000 gauss could be used. Of course, other strengths can be employed. Whatever strengths are selected though, they should be sufficient in terms of orienting the particles for the purposes intended. The strength needed can be determined by a number of factors, for example, the viscosity of the binder/solvent solution, the kind of magnetic particles employed, the desired electron beam dosage for effecting curing, and the desire to minimize surface disruptions caused by the strength of the field.

Reference is now made in particular to FIG. 3 for showing, in greater detail, the permanent magnet assembly 44. Essentially, it includes a casing 46 which houses a permanent magnetic arrangement 48. The casing 46 defines a generally rectangular cavity 52 for holding the magnetic arrangement 48. Defining the bottom of the cavity 52 is a magnetically permeable anchoring plate 54. The casing 46 is made of a non-magnetic material. In this manner, there is less of a tendency for lines of flux from the magnetic arrangement 48 to fringe at the edges thereof as it passes through magnetic layer 12. Accordingly, this improves the tendency for the lines of flux to pass through the layer 12 in the desired perpendicular fashion. Hence, greater uniformity of perpendicularity of particles exists throughout the width of the layer 12. The cavity 52 is sized and configured to retain, in a closely packed arrangement, a plurality of juxtaposed permanent magnets 56. In this embodiment, the magnets are of the rare earth type; such as samarium cobalt. As noted the magnets 56 can have a high remanence in the order of about 9000 gauss. While such strength is advantageous for particle alignment, it presents several significant problems in terms of their assembly and retention in the casing 46. In this regard, the magnets 56 when arranged as illustrated in FIG. 3, have the same magnetic poles facing upwardly for effecting the vertical orientation discussed earlier. Close packaging, however, creates significant repulsive forces which have a tendency to force the magnets apart.

Obviously, this presents difficulties not only when trying to assemble the magnets in the casing but when trying to maintain them in their desired orientation. This tendency is, however, resisted significantly due to the magnetic attractive forces generated by and between each of the interior facing poles of the magnets 56 and the permeable anchoring plate 54. Besides use of the permeable anchoring plate 54, the invention also envisions use of attractive magnetic force generated by another set of magnets in the bottom of the cavity 52 having a polarity opposite to those of the interior facing poles of the magnets 56. Such magnetic attraction would facilitate holding the magnets in their desired orientation. It will be observed that the magnets 56 are arranged to lie in a given plane. In this manner the magnets 56 are uniformly spaced beneath the carrier web 10. It should also be appreciated that the magnets can each have equal strength.

Attached to the casing 46 is a cover assembly 58 having, in the illustrated embodiment, a generally flat configuration. This is for supporting thereon the advancing carrier web 10. The cover assembly 58 contacts the magnets 56 and retains them in their predetermined planar relationship the cavity 52. The cover assembly 58 is made of a thin, non-magnetic material, such as non-magnetic stainless steel. In this manner, the natural extension of the lines of flux emanating from the magnets 56 are not significantly deflected. Therefore, they can pass through the carrier web 10 and orient the particles as desired. Additionally, the assembly plate 58 serves to physically protect the magnets 56 from debris such as the uncured binder/solvent. The stainless steel cover assembly 58 is also chemically inert relative to the composition of the magnetic layer 12. This facilitates cleaning of the cover assembly 58.

Although the present embodiment discloses abutting rows and columns of magnets, it is contemplated by the present invention that such magnets could be closely spaced from each other. Magnetically permeable spacers could be used between the magnets.

Advantageously, the foregoing assembly 44 is especially useful for orienting magnetic particles in making magnetic recording media. The assembly 44 facilitates retention of the assembly of magnets 56 therein, as well as protects such magnets. Advantageously, one can use the conventional smaller magnets. Such assembly promotes the uniform orientation of the particles while protecting the magnets from adverse conditions.

Since certain changes may be made in the above described apparatus without departing from the scope of the invention herein involved, it is intended that all matter contained in the description or shown in the drawings be considered illustrative and not limiting.

What is claimed is:

1. Apparatus for use in orienting particles which are orientable under the influence of a magnetic field comprising:

a non-magnetic housing assembly defining a storage area;

a plurality of discrete permanent magnets, said magnets being stored in said area in juxtaposed and predetermined relationship to one another, wherein each of said magnets has one of its poles facing away from said assembly and in the same general direction and the opposite pole of each of said magnets facing towards said assembly;

means disposed in said assembly for facilitating magnetic attraction between it and said opposite poles, whereby the assembly and retention of said magnets in and to said storage area are enhanced; and said housing assembly including a cover assembly which is in overlying and contacting relationship to each of said one poles so as to restrain said magnets in said predetermined relationship as well as shield them, said cover assembly being made of a material which substantially does not inhibit the natural extension of the lines of flux of the fields of said magnets.

2. The apparatus of claim 1 wherein said magnets produce a generally high intensity magnetic field.

3. The apparatus of claim 2 wherein said magnets are of the rare-earth type.

4. The apparatus of claim 1 wherein said means for facilitating magnetic attraction includes a magnetically permeable member which magnetically cooperates with each of said interior facing poles.

5. The apparatus of claim 4 wherein said cover assembly is defined by a non-magnetic plate which can slidably support thereon an advancing web of material, said material of said plate being such that it can be easily cleaned.

6. Apparatus for use in orienting magnetic particles used in magnetic recording media comprising:

a non-magnetic housing assembly defining a storage area;

a plurality of discrete permanent magnets which define a high intensity magnetic field, said magnets being stored in said area in juxtaposed and predetermined relationship to one another, wherein each of said magnets has one of its poles facing exterior of said assembly and in the same general direction, and the opposite pole of each of said magnets facing interiorly of said assembly;

means disposed in said assembly for facilitating magnetic attraction between it and said interior facing poles, whereby said assembly and the retention of said magnets in and to said storage area are enhanced; and, said housing assembly including a cover assembly in overlying and contacting relationship to each of said exteriorly facing poles, whereby said magnets are restrained in said predetermined relationship and said cover assembly shields said magnets;

said cover assembly being made of a material which substantially does not inhibit the natural extension of the lines of flux of the field of said magnets and is configured for slidably supporting an advancing substrate so as to allow the magnetic particles carried thereby to be oriented under the influence of the magnetic field.

* * * * *